US009072982B1

(12) United States Patent
Mendel

(10) Patent No.: US 9,072,982 B1
(45) **Date of Patent: *Jul. 7, 2015**

(54) HOOP-TYPE AMUSEMENT DEVICE AND COUNTER

(71) Applicant: Nancy Mendel, Palm Beach, FL (US)

(72) Inventor: Nancy Mendel, Palm Beach, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/937,530

(22) Filed: Jul. 9, 2013

Related U.S. Application Data

(63) Continuation-in-part of application No. 13/267,079, filed on Oct. 6, 2011, now Pat. No. 8,480,450, which is a continuation of application No. 12/041,141, filed on Mar. 3, 2008, now Pat. No. 8,033,891, which is a continuation-in-part of application No. 10/953,428, filed on Sep. 29, 2004, now Pat. No. 7,338,339, which is a continuation-in-part of application No. 10/446,925, filed on Sep. 29, 2003, now Pat. No. 6,966,814.

(51) Int. Cl.
*A63H 33/02* (2006.01)
*A63B 19/00* (2006.01)

(52) U.S. Cl.
CPC ..... *A63H 33/02* (2013.01); *A63B 19/00* (2013.01)

(58) Field of Classification Search
USPC ..... 446/85, 236; 482/7, 11, 542.2, 542.6
See application file for complete search history.

(56) References Cited

U.S. PATENT DOCUMENTS

| | | | | |
|---|---|---|---|---|
| 2,756,279 | A | 7/1956 | Lang | |
| 4,480,831 | A | 11/1984 | Muller-Deinhardt | |
| 5,083,964 | A | 1/1992 | Arad et al. | |
| 5,108,340 | A * | 4/1992 | Farrow | 446/242 |
| 5,145,443 | A * | 9/1992 | Vaisnys et al. | 446/242 |
| 6,036,573 | A * | 3/2000 | Huang | 446/242 |
| D442,094 | S * | 5/2001 | Seo | D10/65 |
| 6,497,603 | B1 * | 12/2002 | Magers et al. | 446/242 |
| 7,338,339 | B2 | 3/2008 | Mendel | |
| 8,033,891 | B2 * | 10/2011 | Mendel | 446/236 |
| 8,480,450 | B2 * | 7/2013 | Mendel | 446/236 |

* cited by examiner

*Primary Examiner* — John Ricci
(74) *Attorney, Agent, or Firm* — Mark D. Bowen; Malin Haley DiMaggio & Bowen, P.A.

(57) ABSTRACT

The present invention provides an improved hoop-type amusement device adapted with a counter for counting the number of revolutions achieved by the user. The counter is preferably adapted for attachment to any of a variety of hoop type devices, including the HULA HOOP, as well as specially configured hoop type devices, such as the type that may be formed from a plurality of variously sized and shaped connectable components that are selectively interconnected by the user to form a simple or complex hoop configuration of a particular desired size and shape. The counter functions to count the number of revolutions achieved by the user thereby allowing the user to monitor and gage performance.

4 Claims, 15 Drawing Sheets

HOOP-TYPE AMUSEMENT DEVICE AND COUNTER

CROSS REFERENCE TO RELATED APPLICATIONS

This application is a continuation-in-part of U.S. patent application Ser. No. 13/267,079, filed on Oct. 6, 2011, which is a continuation of U.S. patent application Ser. No. 12/041,141, filed on Mar. 3, 2008, now U.S. Pat. No. 8,033,891 which is a continuation-in-part of U.S. patent application Ser. No. 10/953,428, filed on Sep. 29, 2004, now U.S. Pat. No. 7,338,339, which is a continuation-in-part of U.S. patent application Ser. No. 10/446,925, filed May 28, 2003, now U.S. Pat. No. 6,966,814.

STATEMENT REGARDING FEDERALLY SPONSORED RESEARCH OR DEVELOPMENT

N/A

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office patent file or records, but otherwise reserves all copyrights rights whatsoever.

BACKGROUND OF THE INVENTION

1. Field of the Invention

This invention relates, in general, to hoop-type amusement devices and, more particularly, to a counter for an improved hoop-type amusement device.

2. Description of the Background Art

The HULA HOOP® is an amusement device that was initially introduced by Wham-O, Inc. in the early 1950's. HULA HOOP is a registered trademark of Wham-O, Inc. Since introduction, the HULA HOOP has enjoyed widespread use as a device for physical exercise and amusement used by men, women, and children of all ages. The classic HULA HOOP is formed from a hollow piece of plastic tubing having connected ends so as to form an annular shape having a fixed diameter. The HULA HOOP is generally placed around a users waist, legs, arms, or even neck, and user gyrations cause the HULA HOOP to rotate about the user.

While widely popular, the classic HULA HOOP is burdened with significant limitations. Specifically, the simple annular shape of the HULA HOOP limits its functionality and playing method, such that the user is merely able to rotate the hoop about their waist often causing the user to quickly become bored. Furthermore, the simple hoop structure is further incapable of adjustment of either size or shape thereby limiting appeal.

In an effort to overcome such disadvantages and limitations, a variety of improvements have been proposed and used in the art of hoop-type amusement devices. For example, in an effort to improve playability and/or enhance functionality, luminous hoops, glow-in-the-dark hoops, and fluid filled hoops have been developed and used in the art. Nevertheless, there exists a need for further improvements in technology relating to hoop-type play devices to enhance enjoyment and playability.

SUMMARY OF THE INVENTION

The present invention provides an improved hoop-type amusement device adapted with a counter for counting the number of revolutions achieved by the user. The counter is preferably adapted for attachment to any of a variety of hoop type devices, including the HULA HOOP, as well as specially configured hoop type devices, such as the type that may be formed from a plurality of variously sized and shaped connectable components that are selectively interconnected by the user to form a simple or complex hoop configuration of a particular desired size and shape. Accordingly, as used herein, the term "hoop" may refer to a wide variety of shapes, including annular, square, rectangular, triangular, polygonal, etc. A counter is provided for connection to the hoop assembly. The counter functions to count the number of revolutions achieved by the user thereby allowing the user to monitor and gage performance. A counter in accordance with the present invention is preferably adapted for removable attachment to the hoop-type amusement device.

Accordingly, it is an object of the present invention to provide an improvements relating to hoop-type amusement devices.

Another object of the present invention is to provide a hoop-type amusement device formed of a plurality of connectable components.

Still another object of the present invention is to provide an improved hoop-type amusement device adapted with a counter.

DETAILED DESCRIPTION OF THE INVENTION

Figure 1:
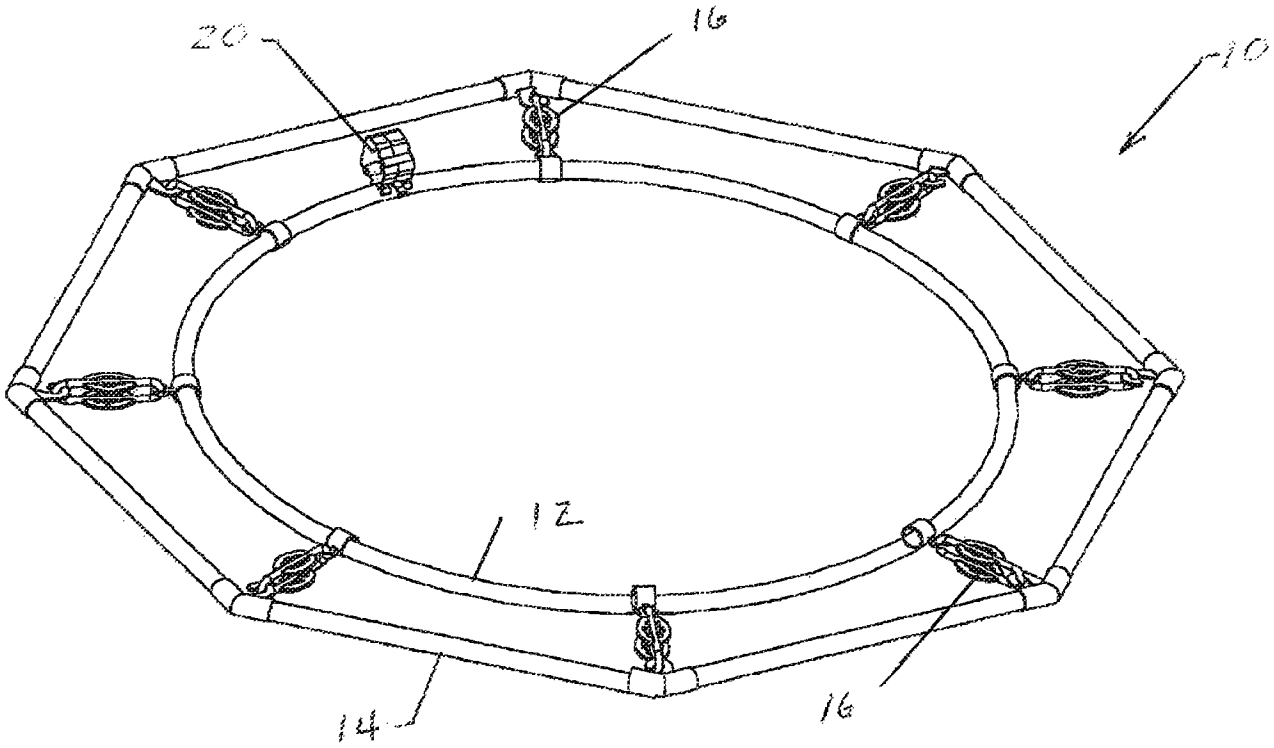
FIG. 1 is a side perspective view of the counter in relation with a hoop-type amusement device.
Figure 2:
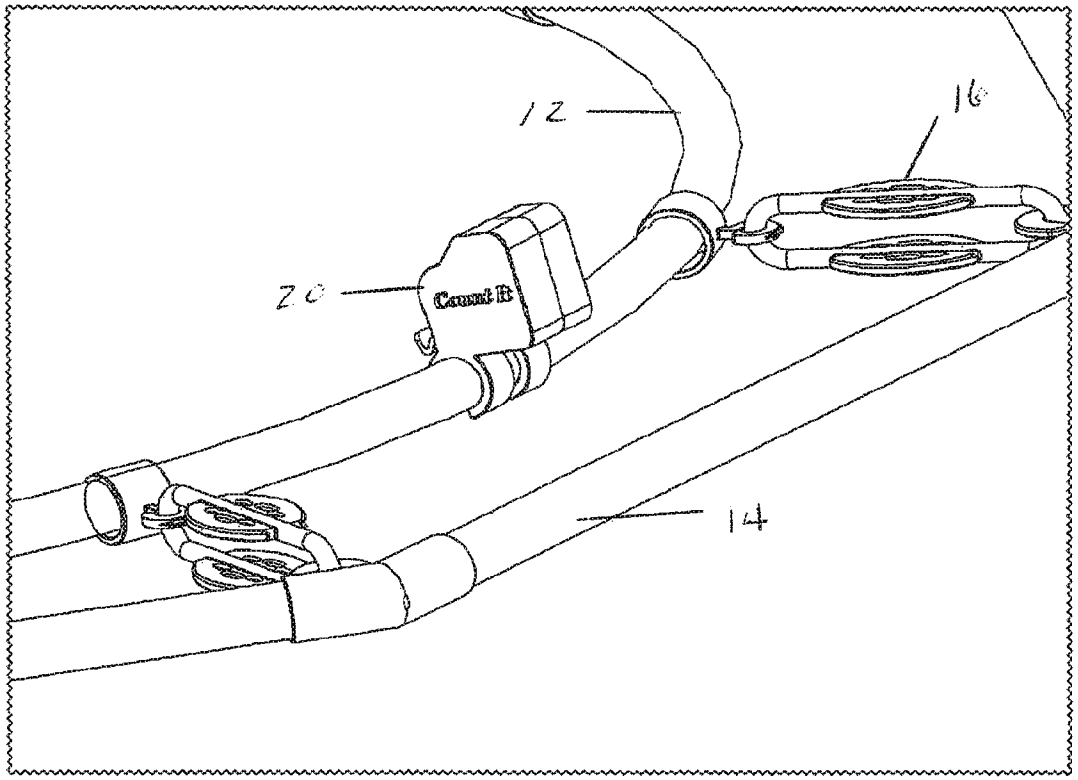
FIG. 2 is a detailed perspective view of the counter in relation with a hoop-type amusement device.
Figure 3:
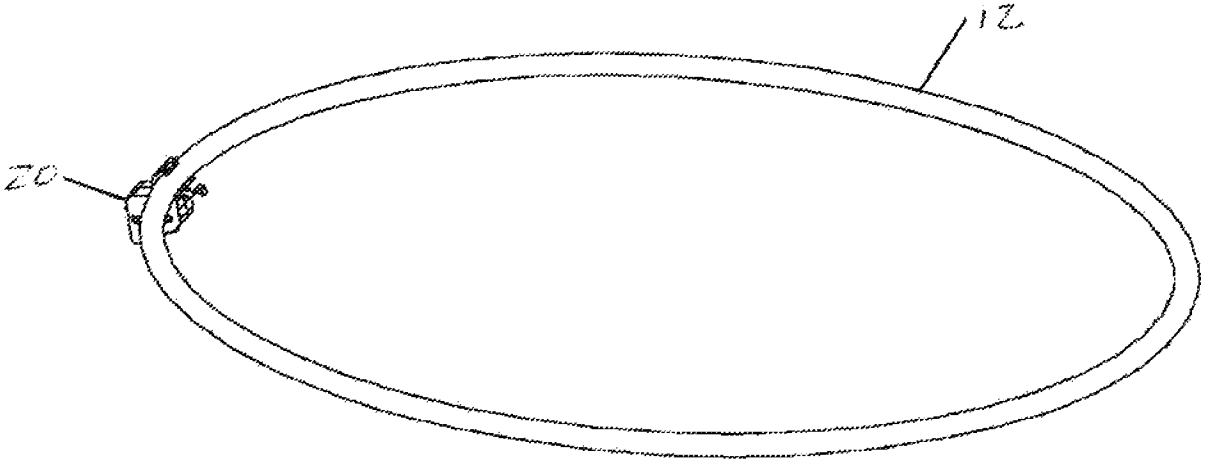
FIG. 3 is a perspective view of the counter in relation with an alternate configuration hoop-type amusement device.

With reference now to the drawings, FIGS. 1-15 show hoop-type amusement device, generally referenced as 10, adapted with a counter 20 in an operational position in accordance with the present invention. FIG. 1 shows counter 20 in relation with a complex hoop-type amusement device, including an inner annular hoop member 12 and an outer octagonal hoop member 14 secured in concentric relation by connectors 16. Device 10 provides a hoop-type amusement device that rotates about the user in response to movement and gyrations produced by the user thus providing the source of amusement. In the operation of the hoop-type amusement device 10, one point of the inner surface of the inner annular hoop member 12 remains in contact with the hips of the user, such that during one complete rotation of the device 10, virtually every point in the entire surface of the inner annular member 12 makes contact with the hip of the user just once.

Figure 4:
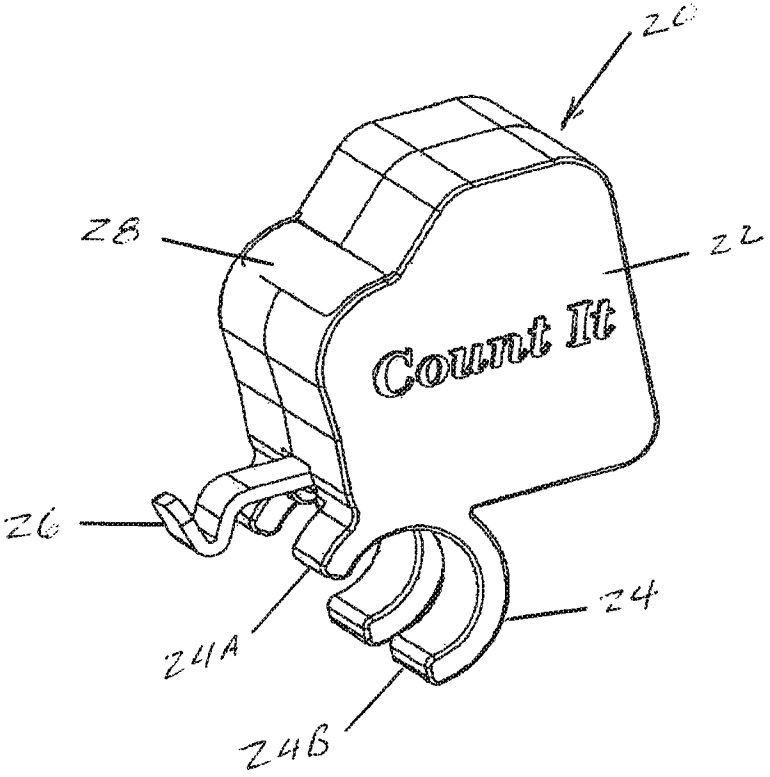
FIG. 4 is a side perspective view of shows a frontal side perspective view of the counter.
Figure 5:
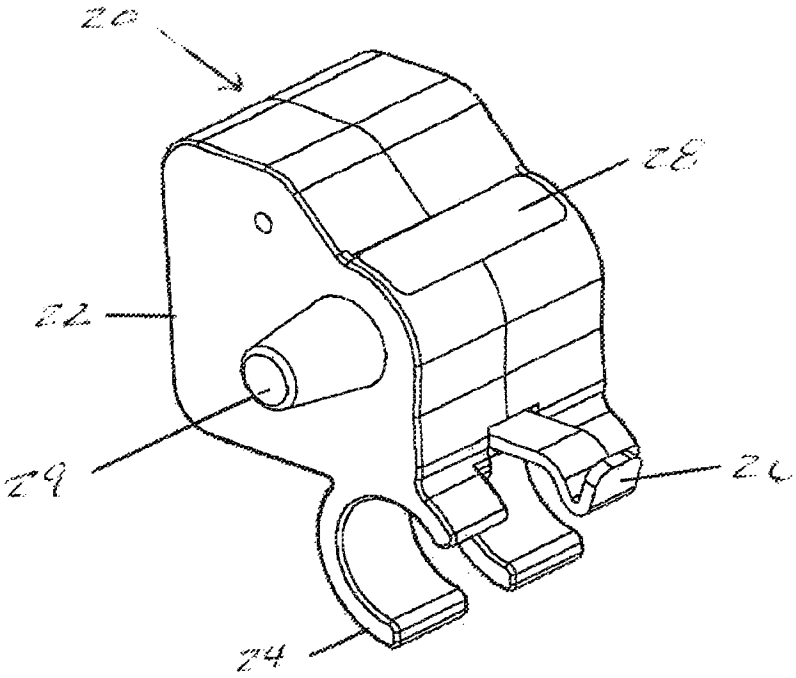
FIG. 5 is an opposing side perspective view thereof.
Figure 6:
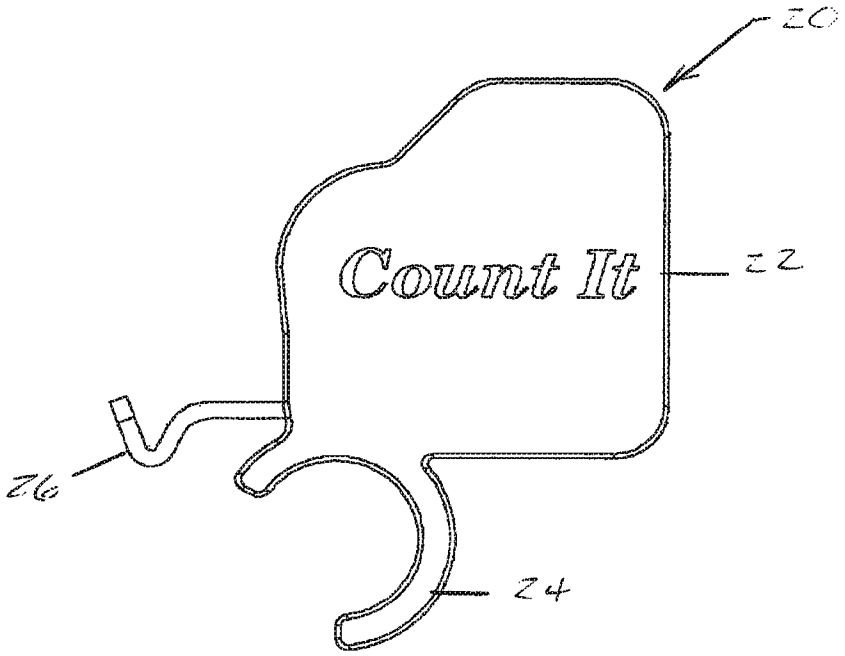
FIG. 6 is a side view thereof.
Figure 7:
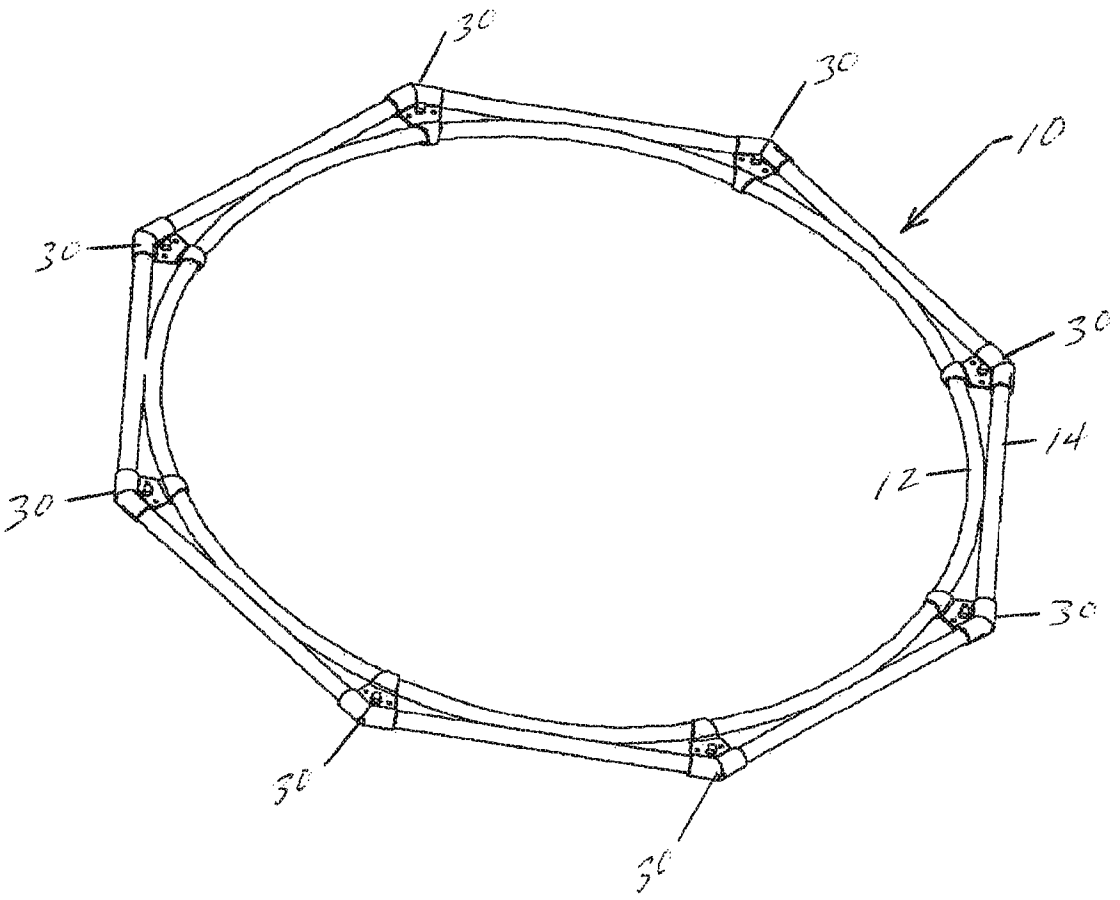
FIG. 7 is top perspective view of an alternate embodiment of the hoop-type amusement device, wherein the counter may be incorporated on a connecting member.

As best illustrated in FIGS. 4-6, counter 20 is preferably adapted to function as either a mechanical or electrical tally counter device, and is specifically configured for attachment to a portion of hoop-type amusement device 10. Counter 20 includes a housing 22 having a C-shaped connector, generally referenced as 24. C-shaped connector 24 is preferably sized and shaped so as to allow for removable attachment of counter housing 22 to inner annular member 12 thereby allowing for removable attachment of counter 20. As should be apparent, C-shaped connector 24 fits tightly enough around the inner annular member 12 to ensure that the counter remains rigidly secured during the operation of the hoop-type amusement device 10.

Counter 20 further includes a counter actuator arm 26 pivotally connected thereto and projecting from housing 22. When counter 20 is in operative engagement with hoop inner annular member 12 actuator arm 26 projects into the void formed radially within the inner angular member 12. Actuator arm 26 terminates in an end portion that is bent upwards so that the bottom of the actuator creates a flat surface that makes contact with the user when the actuator is triggered. As the hoop-type amusement device 10 rotates around the hips of the user, the counter actuator arm 26 is caused to move by contact with the user's body once during every rotation. In turn, every actuation of counter actuator arm 26 represents one full rotation of the hoop-type amusement device 10 about the user. The number of times the counter actuator arm 26 is activated represents the total number of times the hoop-type amusement device 10 has rotated completely around the user. Counter housing 22 further includes a transparent window 28 for displaying the tally to the user. As should be apparent, the tally is continuously updated in real time during the operation of the hoop-type amusement device 10 and actuation of arm 26.

Counter 20 further includes a reset knob 29 to allow the user to reset the counter back to zero, or any other desired count. A counter resetting actuator 29 protrudes from the sidewall 10 of the counter housing 22. Resetting actuator 29 is used to re-set the number that is presented on the counter display to a specific number, such as zero. The number on the display can also be reset to any number depending on the preference of the user. The counter resetting actuator 29 is preferably a rotatable knob that is turned in either a clockwise or counter clockwise direction, however any suitable reset actuator structure is considered within the scope of the present invention.

Counter 20 can be attached to the hoop-type amusement device 10 through any suitable means. In the preferred embodiment, counter 20 is attached through a simple C-shaped connector 24. C-shaped connector 24 consists of two C-shaped extension pieces, referenced as 24*a* and 24*b*, which extend from opposing lateral ends of the bottom front side of the counter housing 22. C-shaped extension pieces 24A and 24B fit around the innermost member of the hoop-type amusement device 10 forming a secure connection as to limit the lateral and vertical displacement of the counter 20 during the operation of the device 10. In a preferred attachment embodiment, counter 20 is mounted in a position so that the front of the housing 22 faces the center of the hoop-type device 10 and the display window 28 faces vertically upward.

Figure 15:
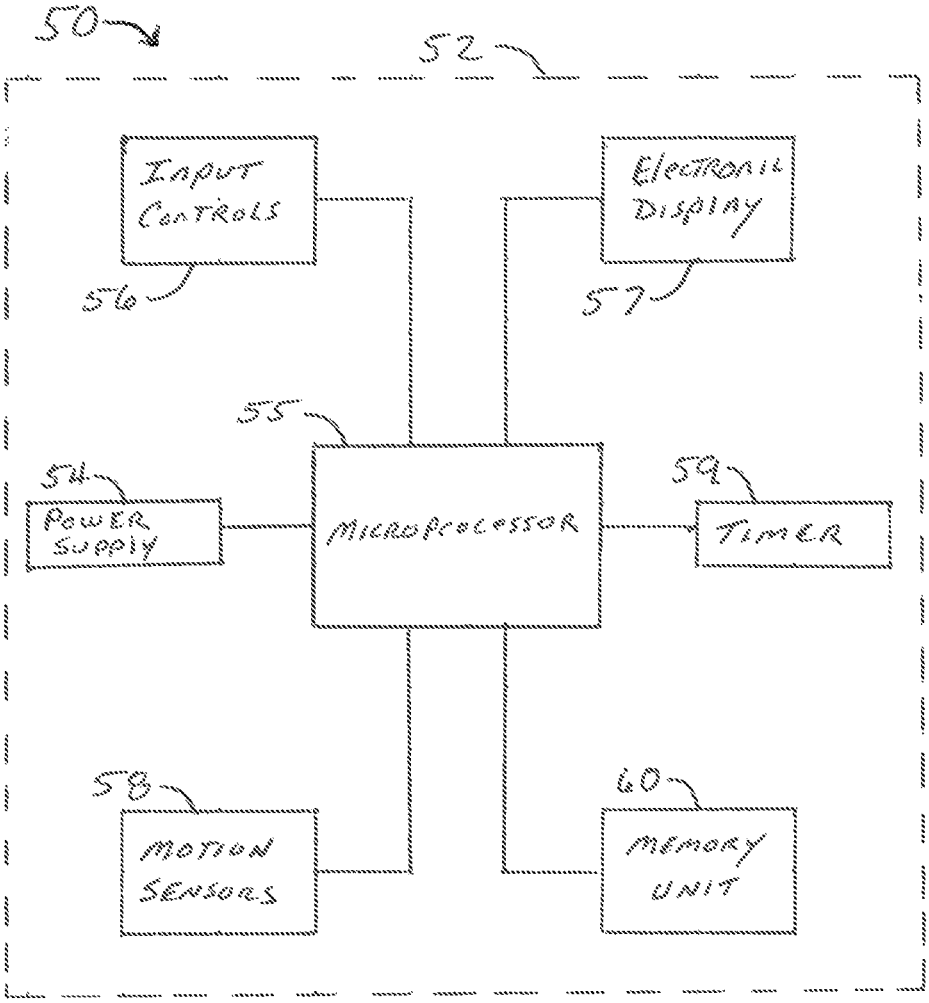
FIG. 15 is a schematic block diagram of an alternate embodiment digital counter.

In a contemplated alternate embodiment a digital device may be used in lieu of the mechanical counter 20. FIG. 15 is a schematic block diagram of an embodiment of a digital counter, generally referenced as 50, in accordance with this embodiment. Digital counter 50 includes a housing 52 that may include a C-shaped clip for use in removably attaching housing 52 to a hoop component as disclosed hereinabove. Digital counter 50 may further include a battery power source 54, microprocessor 55, input controls 56 which may comprise one or more buttons, and an electronic display 57 which may comprise a LCD display to provide visual output. In addition, digital counter 30 preferably includes one or more motion sensors 58, in electrical communication with processor 55. Motion sensors 58 may comprise accelerometers, gyroscopes, or other suitable digital technology that enables the counter to digitally count hoop revolutions. The use of motion sensors eliminates the need for a manually actuated arm. A timer 59 is in electrical communication with microprocessor 55 and functions to provide timing data. A memory unit 60 allows for storage of data obtained by motion sensors 58 and timer 59, as well as for data calculated by microprocessor 55 from such data. Digital counter 50 thus provides an improved system for counting hoop revolutions and time thereby enabling the calculation of various data sets based on hoop revolutions, time, and other potential input such as the height and weight of the user. Accordingly, digital counter 50 allows for the calculation and display of a variety of data including the number of hoop revolutions, use time, calories burned, revolutions per minute, etc.

Figure 8:
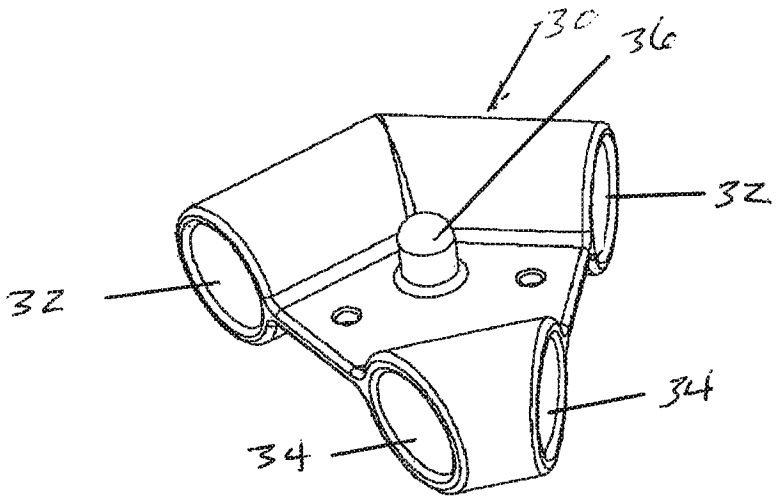
FIG. 8 is a detail perspective view of a component connector adapted to receive a counter in accordance with the present invention.
Figure 9:
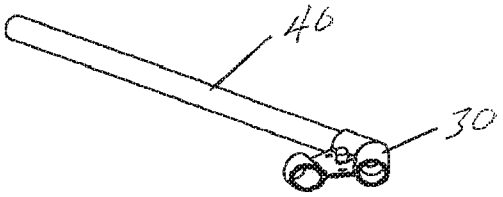
FIG. 9 illustrates a component connector attached to a hoop forming member.
Figure 10:
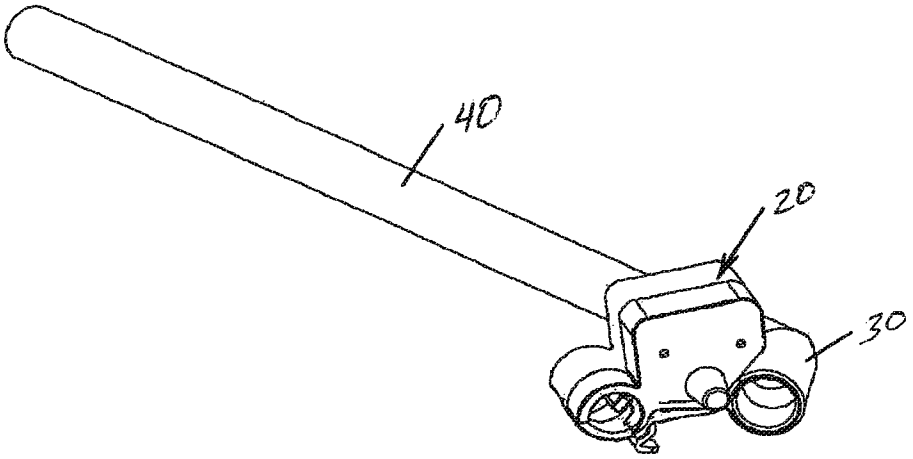
FIG. 10 illustrates a counter attached to the component connector shown in FIGS. 8 and 9.
Figure 11:
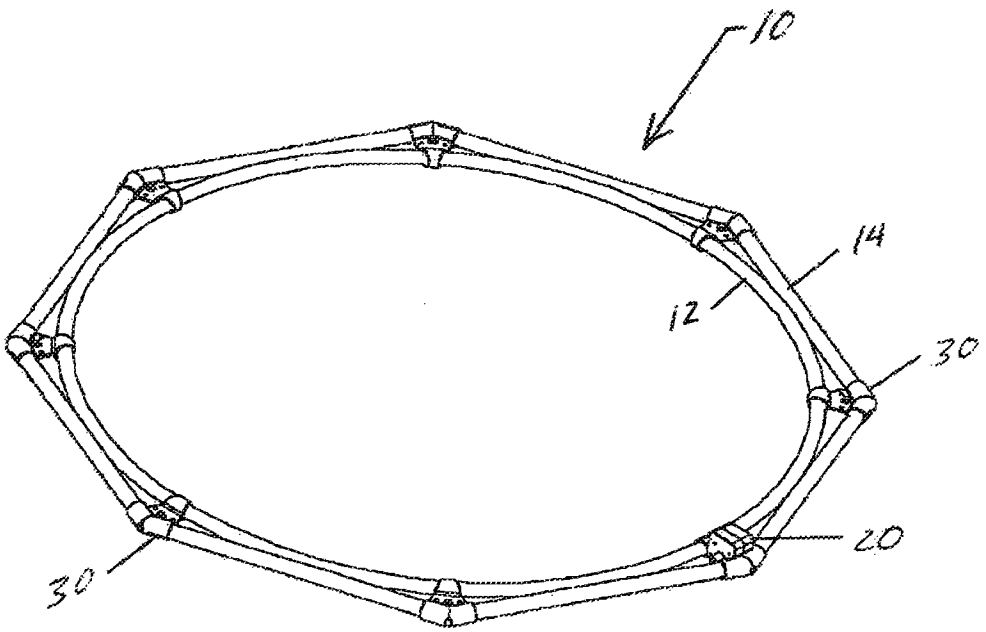
FIG. 11 depicts a composite hoop device having a counter attached to a component connector.
Figure 12:
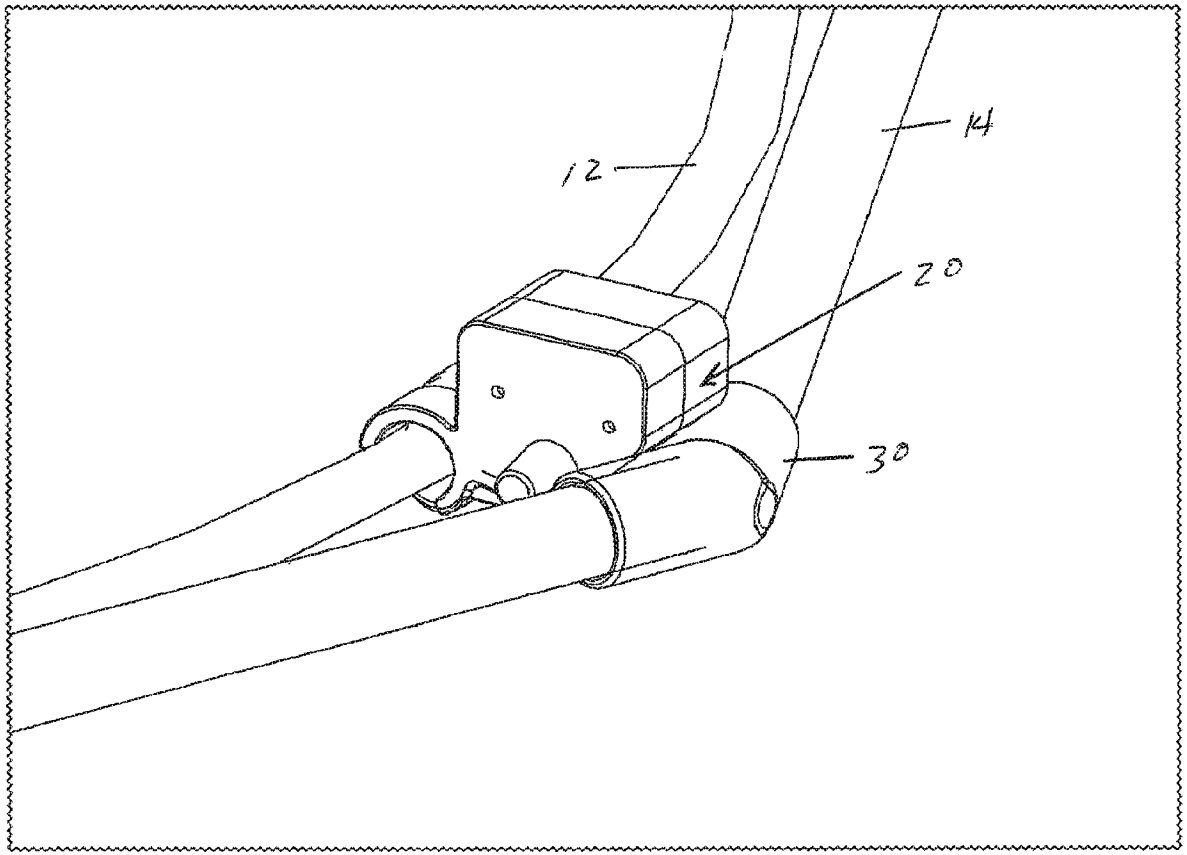
FIG. 12 is a detail partial perspective view of the counter attached to the component connector.
Figure 13:
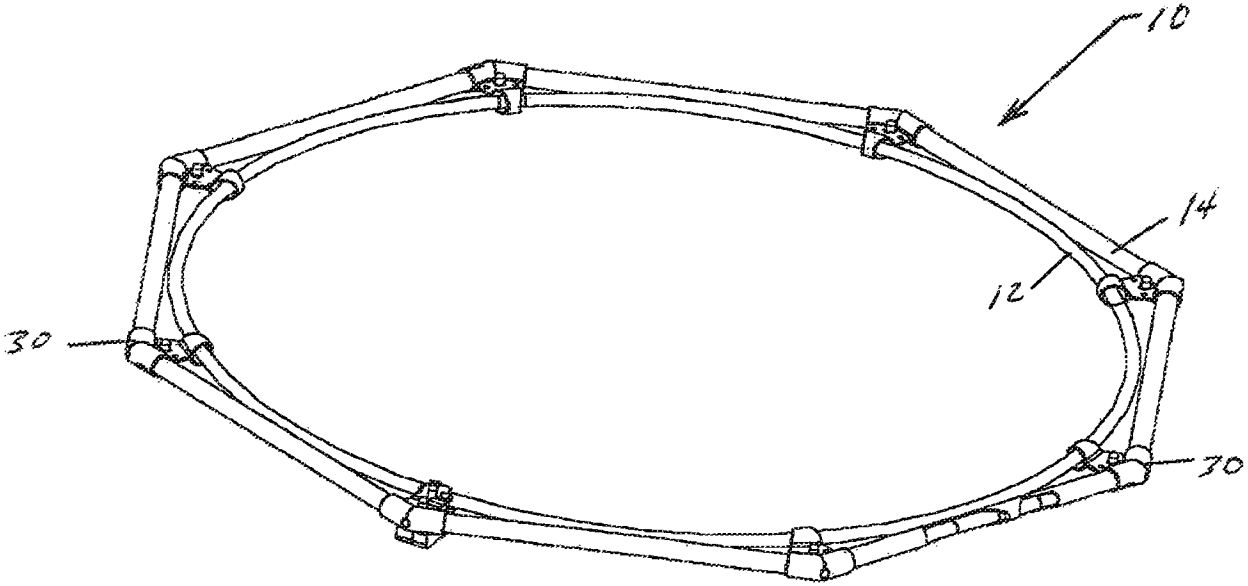
FIG. 13 is a perspective view of a hoop-type amusement device with the counter attached to a component connector.
Figure 14:
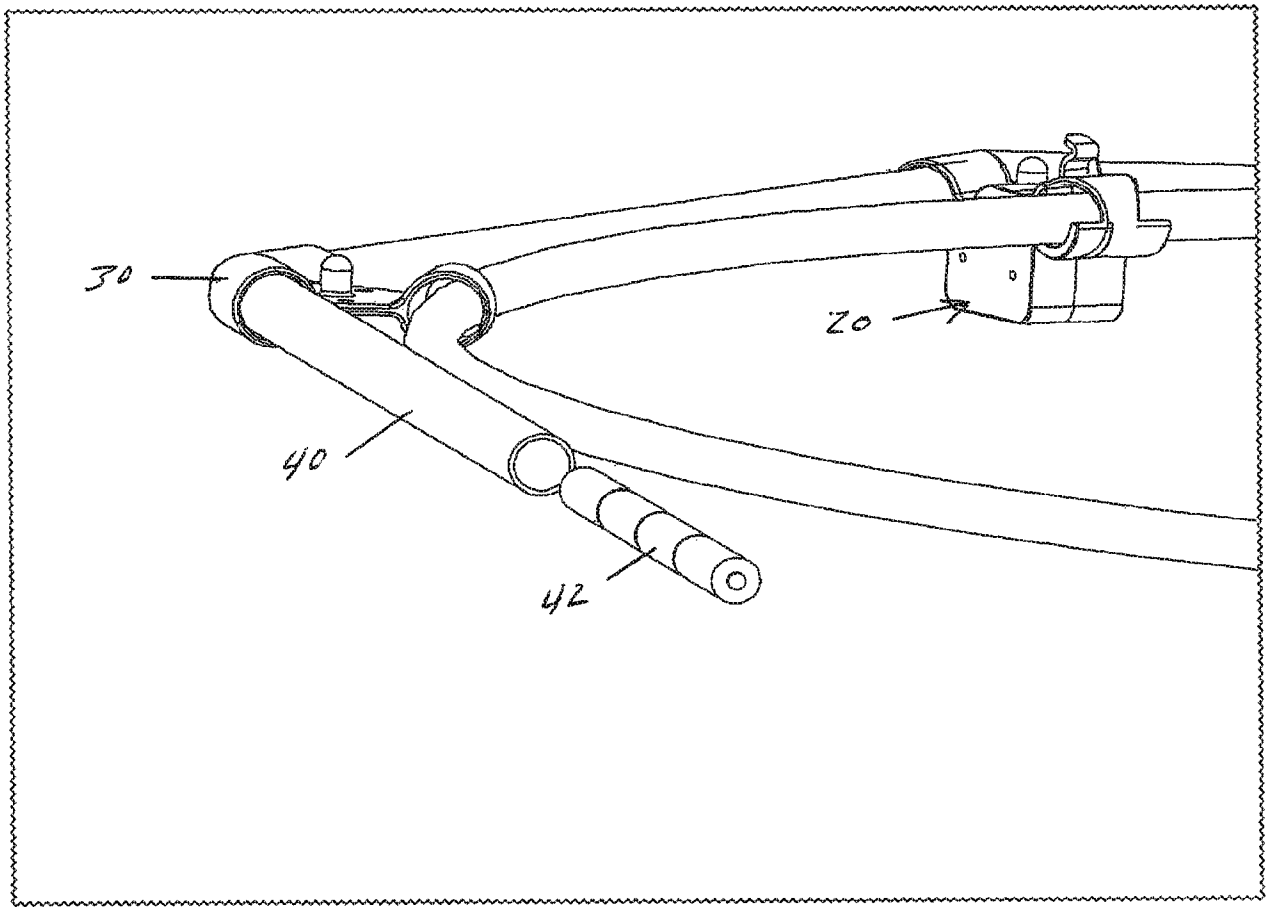
FIG. 14 is a partial exploded view showing hoop-components adapted with a mating extender connector.

FIGS. 7-13 present an alternative embodiment of the present invention, wherein the counter is adapted for attachment to a component connector coupling multiple members that are used to form a complex hoop-type device 10. The complex device configuration can consist of multiple members of varying shapes that are each coupled together. Specifically, FIG. 8 shows a connector member 30 for use in forming an octagonal outer hoop 14 concentrically disposed around an inner circular hoop member 12. A plurality of connectors referenced as 30 are disposed in engagement with inner member 12, and the intersection point of two sides of the octagonal outer member 14 as best seen in FIG. 11. Each connector 30 functions as a coupler for connecting individual side members 40 to form a complete octagonal outer member 14, and further functions to couple octagonal outer member 14 with inner member 12. Accordingly, each connector 30 includes a first pair of tubular openings 32 that receive members forming the outer hoop member, and a second pair of tubular openings 34 that receive members forming the inner hoop member. In addition, inserts 42 may be provided to allow for the connection of members 40 to form an enlarged hoop configuration.

Connector 30 further includes a raised, generally cylindrical, mount 36 that functions to receive a counter 20 in press fit engagement therewith. In this embodiment, counter housing 22 is attached to a mount 36 on one of the connectors 30. In turn, the connectors 30 receive hoop side members 40 which form each side of the octagonal shaped outer member 14. As should be apparent, counter 20 is positioned so that the C-shaped connector 24, which protrudes from counter housing 22 extends inwards towards the center of the hoop-type device 10. More particularly, the C-shaped connector 24 fits around the inner circular member 12, thereby connecting the inner member 12 to the outer member 24.

Counter actuator arm 26 extends from the bottom of the counter housing 22, and projects radially inward so as to be in position to engage a portion of the user's body as the hoop rotates. As with the previous disclosed embodiment of the present invention, activation of the counter actuator arm 26 causes the number stored by counter mechanism to increase by a value of one for each actuation/revolution. Since the counter actuator piece 30 can only be activated once during a full rotation of the hoop-type amusement device 10, the value stored by the counter mechanism represents the total number of rotations performed in the operation of the device 10. As noted above, a reset actuator 29 extends from the side of counter housing 22 into the space between the inner and outer members 12 and 14. The reset actuator 29 can be but is not limited to a winding knob. By turning the winding knob in a specific direction, the reset actuator 29 is activated, and the number stored by the counter mechanism is set to a desired value.

The instant invention has been shown and described herein in what is considered to be the most practical and preferred embodiment. It is recognized, however, that departures may be made therefrom within the scope of the invention and that obvious structural and/or functional modifications will occur to a person skilled in the art.

What I claim is:

1. A hoop-type amusement apparatus for twirling around the waist, limbs, or neck of a user, said apparatus comprising:

an annular inner hoop component sized to permit the twirling thereof around the waist of the user;

an outer hoop component;

means for concentrically connecting said inner and outer hoop components with said outer hoop component disposed in surrounding generally concentric relation with said inner hoop component; and an electronic counter connectable to one of said hoop components, said counter adapted to count revolutions.

2. A hoop-type amusement apparatus according to claim 1, wherein said electronic counter includes a battery power supply, a microprocessor electrically connected to said battery power supply, at least one motion sensor, a timer, at least one input control, and an electronic display.

3. A hoop-type amusement apparatus for twirling around the waist, limbs, or neck of a user, said apparatus comprising:

an annular inner hoop component sized to permit the twirling thereof around the waist of the user;

an outer hoop component;

means for concentrically connecting said inner and outer hoop components with said outer hoop component disposed in surrounding generally concentric relation with said inner hoop component; and means for electronically counting revolutions of said first hoop component.

4. A hoop-type amusement apparatus according to claim 3, wherein said means for electronically counting revolutions includes a battery power supply, a microprocessor electrically connected to said battery power supply, at least one motion sensor, a timer, at least one input control, and an electronic display.

* * * * *